US007568320B2

(12) United States Patent
Paterson et al.

(10) Patent No.: US 7,568,320 B2
(45) Date of Patent: Aug. 4, 2009

(54) WALL REINFORCEMENT SYSTEM

(75) Inventors: Robert I. Paterson, London (GB); Brian A. Breeze, North Shields (GB)

(73) Assignee: Helifix Limited, London (GB)

( * ) Notice: Subject to any disclaimer, the term of this patent is extended or adjusted under 35 U.S.C. 154(b) by 803 days.

(21) Appl. No.: 10/767,803

(22) Filed: Jan. 29, 2004

(65) Prior Publication Data

US 2004/0237440 A1 Dec. 2, 2004

(30) Foreign Application Priority Data

Feb. 3, 2003 (GB) ..... 0302432.0
May 23, 2003 (GB) ..... 0311968.2

(51) Int. Cl.
*E04B 1/38* (2006.01)
*E04B 2/00* (2006.01)
*E04B 1/02* (2006.01)
*E04B 5/04* (2006.01)

(52) U.S. Cl. ..... 52/513; 52/506.01; 52/565; 52/600; 52/699; 52/713; 52/282.4; 52/361

(58) Field of Classification Search ..... 52/506.01, 52/513, 565, 600, 699, 713, 282.4, 288.1, 52/355, 361, 364, 512, 747.1, 745.09, 703, 52/704, 705, 708, 710, 256, 285.2, 379, 714; 411/397

See application file for complete search history.

(56) References Cited

U.S. PATENT DOCUMENTS 1,606,201 A * 11/1926 Willis ..... 52/714
2,338,328 A * 1/1944 Handel ..... 52/699
2,999,571 A * 9/1961 Huber ..... 411/441
3,964,227 A 6/1976 Hala
4,227,359 A * 10/1980 Schlenker ..... 52/713

(Continued)

FOREIGN PATENT DOCUMENTS

DE 3931494 A1 4/1991

(Continued)

OTHER PUBLICATIONS

Search Report from United Kingdom Application No. GB 0402369.3, dated Apr. 26, 2004.

*Primary Examiner*—Richard E Chilcot, Jr.
*Assistant Examiner*—Mark R Wendell
(74) *Attorney, Agent, or Firm*—McDonnell Boehnen Hulbert & Berghoff LLP

(57) ABSTRACT

The present invention relates to a wall reinforcement system, in particular for tying a veneer wall (21) to a back up wall (22). The system can protect a building against adverse seismic or wind loading conditions. A helical wall tie (1) is driven into a back-up wall (22) using a percussion tool. A connector (10) is then placed over the end of the wall tie, the connector engaging with the helical fins to prevent its removal without unscrewing the connector (10). A reinforcement wire (20), which preferably extends around a building, is then threaded through a hole in the connector to lock the rotation of the connector (10). The reinforcement wire is used to link a series of connectors together. The wire is then encased in mortar (24) within the bed joint between two courses of bricks. In preferred embodiments, more than two reinforcement wires extend in parallel along the bed joint.

30 Claims, 3 Drawing Sheets

U.S. PATENT DOCUMENTS 4,473,984 A * 10/1984 Lopez ..... 52/410
4,764,069 A * 8/1988 Reinwall et al. ..... 411/397
4,875,319 A * 10/1989 Hohmann ..... 52/383
5,138,813 A * 8/1992 Cooney et al. ..... 52/600
5,433,569 A * 7/1995 Fall et al. ..... 411/387.3
5,644,889 A * 7/1997 Getz ..... 52/713
5,671,578 A * 9/1997 Hohmann ..... 52/562
5,816,008 A * 10/1998 Hohmann ..... 52/565
6,513,300 B1 * 2/2003 James ..... 52/704

FOREIGN PATENT DOCUMENTS

| | | |
|---|---|---|
| GB | 1166250 | 10/1969 |
| JP | 11200504 | 8/1989 |
| KR | 20-0163891 | 2/2000 |
| KR | 20-0201182 | 11/2000 |

* cited by examiner

WALL REINFORCEMENT SYSTEM

FIELD OF THE INVENTION

The present specification relates to a wall reinforcement system, in particular but in no way limited to, a method of reinforcing a veneer wall by tying it to a back-up wall, to a connector for securing a wall tie to a length of reinforcement wire and to an arrangement for reinforcing a wall constructed from inner and outer leafs of masonry against seismic or wind loading conditions.

BACKGROUND

To meet the needs of new building codes, the use of reinforced masonry veneers is becoming more common. These known systems can reinforce walls against seismic conditions and high wind loads by restricting relative movement perpendicular to the plane of the two leafs of masonry constituting the wall. Most systems currently available are based on ladder-and-truss reinforcement, with some using metal or plastic connectors attached to "loop" ties fixed to the back-up wall. In these systems a wire is fastened into the connector and laid along the bed joint as the wall is built. The systems can be difficult to install and end-play of the connectors hard to reduce to suitable limits.

There is a need for a simpler system which is easier to install in new buildings and cheaper to manufacture.

After a seismic event, masonry may become damaged and need to be repaired or may need to be upgraded to meet current needs. Various methods have been offered to meet these needs using ladder-and-truss reinforcement, but these are generally disruptive, requiring the masonry to be partially dismantled to permit installation, and they make it difficult to ensure that the veneer is re-instated satisfactorily and that the final appearance is to an acceptable standard.

There is therefore also a need for a simpler system which is easier to install in an existing building as a repair or an upgrade which is less disruptive than previous methods and which improves the standard of the final appearance.

SUMMARY

According to a first aspect of the present invention, there is provided a method of reinforcing a veneer wall by tying it to a back-up wall comprising:

installing a fastener into the back-up wall, the fastener having a threaded portion which extends substantially at right angles from the surface of the back-up wall to provide a thread for engagement with a connector;

fitting the connector on to the threaded portion of the fastener, the connector engaging with the thread such that removal of the connector is prevented without rotation of the connector, the connector further having a portion for receiving a reinforcement wire;

fitting the reinforcement wire in to said receiving portion of the connector, the reinforcement wire extending substantially at right angles to the fastener and preventing rotation of the connector with respect to the fastener; and integrating the reinforcement wire with the veneer wall by securing the reinforcement wire within a mortar bed joint of the veneer wall.

Preferably the fastener is a metal wall tie, preferably of the helical type made from twisted profiled wire. Although the fasteners could be in the form of a simple flat twisted strip, more preferably they are in the form of twisted wire having a more complicated cross-sectional profile in the form of a cross or a star ("twisted profiled wire"), so that the tie has a well-defined longitudinally extending core (for transmitting tensile forces) and radiating fins which have been twisted into a helical structure (for mechanical engagement with the masonry). These wall ties can be driven into a masonry back-up wall using a suitable percussion tool, the wall ties being allowed to rotate as the fins cut a helical path into the masonry to form a mechanical interlock with the masonry. Such a wall tie system is available through Helifix Ltd and marketed under the name "DRYFIX"®. For other installation systems it may be more preferable to install the wall tie or other fastener by first drilling a pilot hole and then securing the tie to the back-up wall using an adhesive, such as a resin or cement.

Although for the majority of applications the connector and reinforcement system are intended for use with a masonry back-up wall, e.g., brick, concrete, block etc, this need not be the case as the veneer reinforcing system could attach to back-up walls of other materials. In one embodiment envisaged herein, the tying system is used to secure a veneer wall to a timber back-up wall.

An important point of the fastener is that it extends substantially at right angles to the plane of the back-up wall and that it is fixed securely to the back-up wall to provide an anchorage in the form of a thread for the connector and reinforcement wire assembly.

In the case of the wall ties made from twisted profiled wire, the twist of the wire means that helical fins provide a thread along their entire length for the connector to engage with; the portion of the wall tie protruding from the back-up wall is therefore the "threaded portion" referred to above. The thread of these wall ties is of a much larger pitch than that typically provided on standard bolts, for example, of the order of 40 mm (the helical fins of the preferred wire creating a peak when viewed from the side every 20 mm because of the helical path of the second fin extending from the opposite side of the core to the first fin). This large pitch makes fitting of the connector by screwing it on to the wall tie a quick operation. Such ties also benefit from being easy to manufacture as long lengths of twisted profiled wire which are then cut into suitable sizes of wall tie, they can be installed in the back-up wall easily with a percussion tool as discussed above and they provide drip points along their length due to their helical nature so that moisture does not cross the cavity between the veneer wall and the back-up wall. They can also be used as a repair wall tie to replace existing ties that have corroded or to reinforce an existing structure that has been found to be subsiding or has suffered damage from a seismic event. Such forms of fastener are significantly easier to install and cheaper to manufacture than the more complicated ladder-and-truss or plate type arrangements of the prior art. The provision of a long thread, where the connector can engage anywhere along the exposed part of the fastener, also allows for greater freedom for positioning of the connector and reinforcement wire.

In another embodiment, the wall tie could be a length of twisted profiled wire having two or more sections of different external diameter. For example, a wider external diameter portion may provide greater anchorage in a softer back-up wall material but such a diameter might be too large for the mortar bed of the veneer wall and so a smaller external diameter may be required for this portion. In some applications, the two diameter tie may be more appropriate the other way around with the narrower diameter portion secured into the back-up wall.

However, other forms of fasteners are also envisaged as being suitable for this system although are not as preferred as the wall ties discussed above because of component costs and ease of installation. The fastener may take the form of an expandable anchor having a thread provided on one end for engagement with the connector. Other arrangements for securing the fastener to the back-up wall are also envisaged and the arrangements described herein are in no way intended to be exhaustive.

The end of the fastener protruding from the back-up wall includes a thread for attachment of the connector. In the preferred embodiment of wall ties made from twisted profiled wire, the longitudinal elevation (i.e., when the tie is viewed from the side) takes the form of a series of peaks and troughs as the fins spiral around the core of the wall tie. The peaks define a maximum external diameter of the wall tie and the troughs define the minimum diameter. The connector, which is preferably in the form of a closely fitting sleeve that fits over the protruding end of the wall tie, has a narrowed section or restriction where the separation of opposing portions of the internal surface is less than the maximum diameter of the wall tie but greater than the minimum diameter, i.e., the opposing surfaces of the narrowed section fit within the trough of the fins.

In the most preferred embodiment, the connector consists of a metal tube having a crimped section defining two opposed flat surfaces of separation s where $d_{min}<s<d_{max}$, and $d_{min}$ and $d_{max}$ are the minimum and maximum diameters of the wall tie respectively. The crimped section may be at the end of the tube, adjacent the end of the tube or further up the tube in a central region. The flat surfaces engage with the edges of the fins on the wall tie so that the connector can only be pulled off the wall tie by rotating the connector to unthread it from the wall tie.

By "closely fitting",it is intended that the sleeve should have an internal diameter of not more than one or two millimeters greater than the maximum external diameter of the wall tie, preferably less than one millimeter and more preferably less than half a millimeter, in order to reduce the amount of lateral end play between the connector and the wall tie, i.e., there should be just sufficient gap to provide clearance for ease of fitting. In some preferred embodiments it may be necessary to tap the connector on to the wall tie with a hammer or other similar device. The connector is of a length which preferably can receive a portion of the wall tie equivalent in length to more than three times the maximum external diameter of the wall tie, more preferably more than five times the diameter, again in order to avoid lateral play between the end of the wall tie and the sleeve connector.

In its simplest form, the connector is a tube having a crimped section at or close to one end. In more preferred embodiments, at least a second crimped section is provided for engagement with the fins of the wall tie to reduce longitudinal end play and this may also provide greater pull-off strength. Due to the direction of oscillations experienced during a seismic event or adverse wind loading, i.e., perpendicular to the plane of the veneer wall, it is important to minimize the longitudinal end play in the connector. Lateral end play is less important because the components are encased in mortar or other filler material, although too much lateral play can make the system appear inferior. More than two crimped sections (e.g., three or four) can be provided as necessary.

The crimped section may be formed with a tool to create an indent of a width corresponding to the full width of the trough in the side-on profile of the wall tie (say, between 2-5 mm wide) or may be formed by a tool with narrow jaws, which can be easier to operate, creating a narrow line of deformed material (about 1 mm wide or less). Where the indents are narrow, it is preferable to include a second set of indents spaced from the first set at an appropriate location so that longitudinal end play in the system is minimized and there is engagement with the fins of the wall tie as soon as longitudinal movement of the connector occurs. The indents are preferably made on what are the upper and lower surfaces in use. This has the advantage that any lateral deformation, i.e., bulging of the connector caused through squashing during crimping, is in the plane of the bed joint. Where two or more sets of crimped sections are provided, preferably these are also arranged on the upper and lower surfaces so that any lateral bulging of the connector from these also extends in the plane of the bed joint.

Thus from a second aspect, the present invention provides a connector for connecting a reinforcement wire to a wall tie extending substantially at right angles to the reinforcement wire, the wall tie comprising a twisted wire having helical fins extending therealong, wherein the connector comprises:

a tube of internal diameter which closely fits the external diameter of the helical fins of the wall tie for providing a sleeve which engages over one end of the wall tie;

a hole passing through opposing sides of the tube wall substantially at right angles to the longitudinal axis of the tube, the hole being of a size for receiving the reinforcement wire; and at least one region of narrowed internal diameter for engaging the helical fins of the wall tie to prevent withdrawal of the wall tie from the connector without respective rotation between the connector and the wall tie.

In one preferred embodiment, the tube has an internal diameter of between 6 and 12 mm, preferably within 7 and 10 mm and most preferably of about 8 mm. An internal diameter of 8 mm is most preferred for a helical tie of 8 mm external diameter. Larger internal diameters, e.g., 10 mm or larger would be required where larger diameter helical ties are being used. One preferred helical tie which has been found to have good strength properties has an external diameter of 10 mm, so for such a tie a preferred connector may have an internal diameter of 10-12 mm. The tube is preferably of a length of between 50 and 100 mm, more preferably between 60 and 90 mm and most preferably about 65-80 mm long. Preferably the connector has an external diameter of 10 mm or less, most preferably about 9.5 mm. In this way the connector can fit within the space of a typical mortar bed joint, which is usually of a height of 10-12 mm. Larger external diameters can also be accommodated by siting the connector on a bed joint at the junction of a pair of bricks, as the junction provides additional space for, for example, a top portion of the connector to extend into. If necessary, the corners of the bricks can be removed to provide more room for the connector.

The region of narrowed internal diameter preferably reduces the distance between opposed internal surfaces of the tube by 1 mm, more preferably 2 mm and yet more preferably by greater than 2.5 mm (e.g., for the 8 mm internal diameter version). The hole for the reinforcement wire is preferably of a diameter which is 1 mm less than the internal diameter of the tube or smaller, more preferably 2 mm less than the internal diameter and most preferably more than 2 mm smaller than the internal diameter of the tube. Preferably the narrowed region comprises two flats, e.g., from crimping the tube, the two flats extending in a direction parallel to the axis of the hole for the reinforcement wire and perpendicular to the axis of the tube. Depending on the shape of the jaws of the crimping tool, the surfaces may have some other profile, e.g., convex or concave. The connector may be made from any suitable strong metallic material such as stainless steel, aluminium, copper and mild steel. When the system has been embedded in the mortar of the bed joint, it is effectively encased in a dry, air-free, alkaline environment. If the connector is of a size which extends into the cavity behind the veneer wall then it should be of stainless steel or a galvanised material to minimize possible corrosion.

It is also envisaged that the connectors can be moulded from a suitably hard plastics material, the narrowed section being moulded as an integral part of the connector rather than being formed by crimping. When such a connector is encased in mortar or a similar hard bed joint material, the sides of the connector are locked in position around the thread of the fastener.

Forming the narrowed section by crimping means that the construction of the connector is simple and can even allow for the tube to be crimped on-site just prior to installation on the fastener, or even in situ once the connector has been positioned on the fastener with a suitable crimping tool. However, because inspection of the fitted connector is impossible once it is encased in the bed joint, it is preferred that the connector arrives on-site in a ready-crimped form to avoid the risk of possible poor on-site fitting.

If desired, the connector can be of more complex construction having a narrowed section formed by providing additional material, e.g., by casting or moulding, or by the provision of an internal thread, or even include a hardened internal member of a form which creates a constriction for engagement with the fins of the wall tie. In some embodiments, an internal thread of a pitch substantially matching that of the fastener (e.g, two threads of 40 mm pitch) can be provided in the bore of the connector rather than the restriction described above. Whilst such a connector would benefit from greater contact surface area over which the tensile forces are spread, it has been found that the simple indents are sufficient to transmit these forces, with the pull-off strength being governed by the strength of the helical fins of the twisted profile wire, not the strength of the indents. The system could also extend to connectors having an external thread for engagement with an internal profile of the fastener, although in view of the far more complex construction required, such a system is regarded as being undesirable from a commercial point of view.

The receiving portion of the connector that is provided for the reinforcement wire preferably takes the form of a hole passing through the opposite end of the connector to that engaging the thread of the fastener. In this way the reinforcing wire can be threaded through the hole of one connector, through the hole of an adjacent connector and so forth along the mortar bed joint to link a plurality of connectors and wall ties to a single length of reinforcement wire. In the most preferred embodiment, the connector is a length of metal tube which has been drilled at right angles to the length of the connector thereby forming two opposed holes in the wall of the tube of smaller diameter than the external diameter of the tube, thereby forming a passage which extends substantially at right angles to the longitudinal axis of the tube (i.e., the hole for threading the reinforcement wire through).

Arrangements are envisaged where the axis of the tube and the axis of the hole forming the receiving portion are off-set in relation to each other, but preferably these are in-line to minimize the space required in the mortar bed joint. This can be seen in contrast to many of the known ladder-and-truss systems where the plate-type fasteners have raised lugs on their surface to clasp a reinforcement wire.

In other embodiments, the connector may be solid at this receiving portion. The internal surface of the receiving portion may be just a hollow or formed into a hook-like arrangement in which the reinforcement wire is located. Such an arrangement may be preferred for repair applications where a connector is being hooked on to an existing reinforcement wire.

The engaging surface of the receiving portion should be of a shape which does not permit rotation of the connector once the reinforcement wire has been installed, for example, as a result of engagement of the sides of the connector with the surface of the reinforcement wire blocking the rotation. Again the receiving portion should closely fit the external profile of the reinforcement wire so as to reduce the amount of play in the system where possible. If desired, the connector could be provided with two, three, or more receiving portions, e.g., additional holes, for receiving additional reinforcement wires which can be laid in parallel along the bed joint as required.

The reinforcement wire can be of any size to suit the conditions. Typically it is of 9 gauge (3/16" or 5 mm) and could be of circular profile or a more complicated profile, for example of twisted profiled wire material, the fins of which can then grip the mortar of the bed joint. The material of choice is stainless steel although other materials which would not corrode in that environment may also be suitable and provide a cheaper alternative. The reinforcement wire preferably extends along the length of the wall, and more preferably around the building to reinforce the structure. More than one (e.g., two, three or four) parallel reinforcement wires may be provided in the mortar bed joint of the veneer wall.

Thus according to a third aspect of the present invention disclosed herein, there is provided a system for reinforcing a veneer wall against seismic conditions or wind loading comprising:

a fastener which is installed into a back-up wall of a structure, the fastener having a threaded portion which extends substantially at right angles from the surface of the back-up wall to provide a thread for engagement with a connector;

a connector which is fitted on to the threaded portion of the fastener, the connector having means for engagement with the thread of the fastener such that removal of the connector is prevented without rotation of the connector, the connector further having a portion for receiving a reinforcement wire;

a reinforcement wire which is fitted in to said receiving portion of the connector, the reinforcement wire extending substantially at right angles to the fastener and preventing rotation of the connector with respect to the fastener; and the connector, reinforcement wire and preferably a portion of the fastener being encased in filler material provided within a bed joint of the veneer wall to integrate the reinforcement with the veneer wall.

When the system is applied to a new building, the components are fitted at appropriate positions as the courses of masonry are laid, in the process the connector, a small portion of the fastener and the reinforcement wire are preferably encased in the mortar of the bed joint. When the system is applied to an existing building as a repair, mortar is first removed from a bed joint in the veneer wall, the fasteners are inserted into the back-up wall, connectors are fitted to the fasteners and a reinforcement wire is then threaded through or hooked to the connectors to link them all together, in so doing preventing further rotation of the connectors. Once all the components are in place, a bonding filler material can be applied to the bed joint to encase the components and seal them from external conditions. This can be a resinous, e.g., epoxy or polyester based, filler material but is more preferably a cement based material which ensures a good bond to the existing brickwork. Traditional mortar can then be used as necessary for the final pointing to match the pointing of the rest of the building.

In accordance with one further aspect of the present invention, there is provided a method of reinforcing a wall against seismic or adverse wall loading conditions comprising:

driving one end of a helical wall tie into an inner leaf of said wall, the wall tie being secured in position through mechanical interlock with the inner leaf without the presence of an adhesive, the wall tie having a second end extending substantially at right angles to the plane of the wall;

placing a connector over the second end of the wall tie, the connector comprising a portion having a narrowed diameter defined by opposed flats, the flats having a spacing which is less than the external diameter of the helical fins of the wall tie such that withdrawal of the connector along the helical fins of the wall tie requires rotation of the connector, the connector further having a portion with a hole for receiving a reinforcement wire therethrough substantially at right angles to the wall tie;

threading a reinforcement wire through said hole of the connector;

securing the reinforcing wire and connector in a filler material within a bed joint of a second leaf of the wall.

BRIEF DESCRIPTION OF THE DRAWINGS

Certain preferred embodiments of the present invention will now be described by way of example only and with reference to the accompanying drawings in which.

DETAILED DESCRIPTION

Masonry veneers may require maintenance and repair to restore performance lost as a result of age, corrosion of existing reinforcement resulting in spalling, cracking and de-bonding, or to correct damage following a seismic event. With more rigorous standards being imposed on building owners, masonry may require upgrading to attain modern performance requirements.

Various methods are available but they are generally designed for new construction only and are disruptive when applied to existing masonry. For upgrades or maintenance the masonry has to be partially dismantled to permit installation, making it extremely difficult to re-build the masonry without severe disfigurement.

The present invention provides a solution to this problem which can be retrofitted to existing buildings or used in new construction, is non-disruptive and is simple and easy to install.

Figure 1:
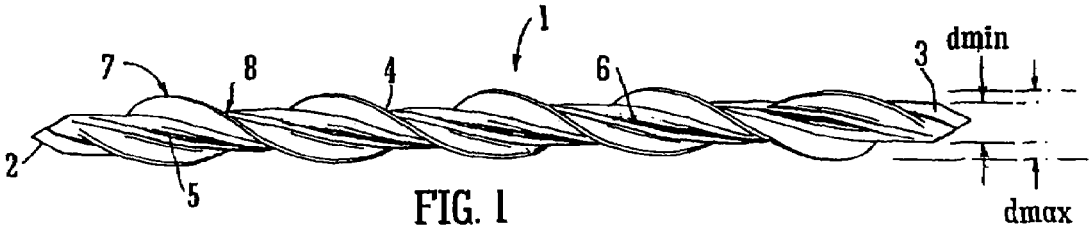
FIG. 1 illustrates a side view of a preferred fastener for the back-up wall.

As shown in FIG. 1, a preferred wall tie fastener 1 consists of a twisted profiled wire 1 having pointed ends 2, 3. The wall ties 1 are constructed of stainless steel which has been rolled into a desired profile, twisted into a helical section and then cut into suitable lengths. The cross-sectional profile of the wire is a cross having major and minor outwardly extending fins 4, 5 radiating from a core 6. The major fins 4 provide a thread for engagement by the connector (to be described in more detail below). The wall tie 1 can be driven into the masonry using a percussion tool, the fins 4, 5 acting as blades which cut a helical path into the masonry under the hammer impacts from the tool. No adhesive is required to secure the wall tie 1 in position, with the fins providing a sufficient mechanical interlock with the masonry.

The maximum external diameter $d_{max}$ of the wall tie 1 is defined by the diameter of the major fins 4. In side elevation, as these major fins 4 twist around the core 6, they are seen to define a series of peaks 7 and troughs 8 along the length of the wall tie 1. Whereas the peaks give rise to the diameter $d_{max}$, the troughs have a diameter of $d_{min}$ equal to the diameter of the minor fins 5 in the cross-shape profile of the FIG. 1 embodiment. If the minor fins 5 were not present on the wall tie 1 then $d_{min}$ would be equal to the diameter of the core 6. In embodiments of more complex geometry, say where three major fins are provided or where two major and four minor fins are provided, $d_{min}$ would be defined again by the smallest width of the wall tie 1 when viewed from the side.

Figure 2:
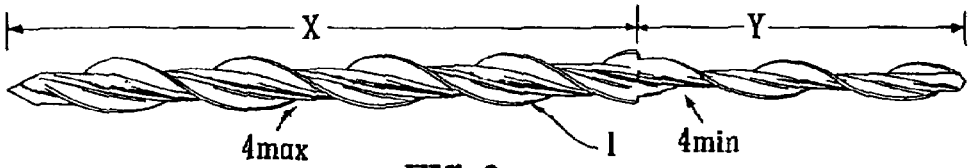
FIG. 2 illustrates a side view of another fastener.

An alternative wall tie is shown in FIG. 2 having two sections X, Y of differing external diameter. For certain soft materials, e.g., aerated concrete blocks, a larger maximum diameter of helical fin $\mathbf{4}_{max}$ may be required to secure the wall tie in position, and a smaller diameter of major helical fin $\mathbf{4}_{min}$ may be required (e.g., once sleeved with the connector) in order to fit within the bed joint of the veneer wall. In normal use as a wall tie, the wall tie shown in FIG. 2 would be used the other way around with the smaller diameter portion being driven into the back-up wall. Depending on the nature of the back-up and veneer wall materials, in certain applications it may be more appropriate to use the tie the other way around, say, where the helical fins of the tie are actively engaging the back-up wall and a portion of the veneer wall (e.g., mortar in the bed joint) to provide a wall tying function in addition to providing a thread for engagement of the connector 10 for reinforcement against seismic events.

Figure 3:
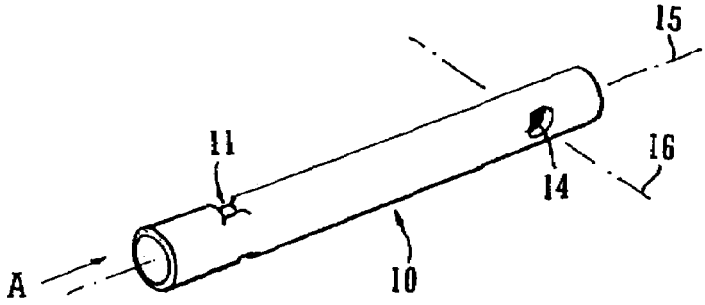
FIG. 3 illustrates a perspective view of a preferred connector for engagement with the fastener of FIG. 1.
Figure 4:
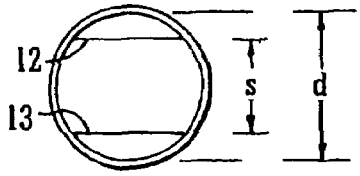
FIG. 4 illustrates the end view of the connector of FIG. 3 from the direction shown by Arrow A in FIG. 3.

In FIG. 3 there is shown a perspective view of a preferred connector 10 comprising a length of metal tube of internal diameter D (see FIG. 4) where $D>d_{max}$. The connector includes a narrowed section 11 where the connector 10 has been crimped between a pair of opposed jaws of a crimping device (not shown). This reduces the internal diameter D of the connector 10 by providing two opposed, preferably flat, surfaces 12, 13 of separation s where $s<D$ and $d_{min}<s<d_{max}$. Thus when the connector 10 is sleeved over the end 3 of the wall tie 1 protruding from the back-up wall, the flat surfaces 12, 13 of the narrowed section 11 sit in-between the peaks of the wall tie 1 and engage the edges of the major fins 4 so that the connector 10 can only be removed from the wall tie 1 by unscrewing it, and hence rotating it with respect to the wall tie 1. The major fins 4 therefore act as a large thread which the flat surfaces 12, 13 of the narrowed region 11 engage with. In this way, once a first end 2 of the wall tie 1 has been driven into the back-up wall with a percussion tool, the connector 10 can be easily fitted on to the other end 3 and into position on the bed joint of the veneer wall for receiving the reinforcement wire.

Figure 5:
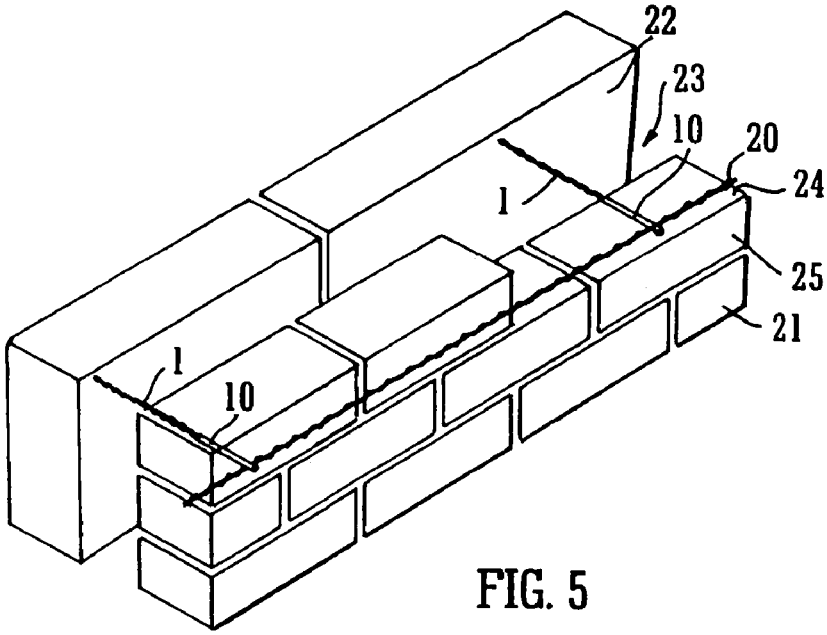
FIG. 5 illustrates a preferred system installed in the construction of a new building.

A hole 14 is provided in the other end of the connector for receiving a reinforcement wire 20 (see FIG. 5). The hole 14 extends through both sides of the connector substantially at right angles to the axis 15 of the connector 10 and with its axis 16 substantially in-line with the axis 15 of the connector 10. When the connector 10 is in position on the wall tie 1, the wall tie 1 does not extend so far as to obscure the hole 14. The diameter of the hole 14 is such as to receive the reinforcement wire 20 easily with minimum play. The connector 10 is of a length which preferably fits within the bed joint of the veneer wall.

In tests, it has been found that the connector 10 can withstand pull-off loads of between around 1-1.5 kN. Longitudinal end-play is preferably less than 2 mm, more preferably less than 1 mm.

A preferred connector 10 may have an external diameter of 10 mm or less, be approximately 70 mm long, have an internal diameter of 8 mm, have a first set of indents arranged at 10 mm from one end, a second set of indents at 20-23 mm from that one end, the indents narrowing the internal diameter by up to 3 mm, and a hole 14 of 6 mm diameter extending at right angles to the tube and arranged at 10 mm from the other end for receiving the reinforcement wire.

A method of reinforcing the veneer wall 21 of a new building by tying it to a back-up wall 22 separated by a cavity 23 is illustrated in FIG. 5.

First the bed joint 24 and positions where the wall ties 1 are to be inserted are selected. If required, the back-up wall 22 is drilled to provide a pilot hole for the wall tie 1. The end 2 of the wall tie 1 is then driven into the back-up wall 22 with a percussion tool leaving the other tie end 3 protruding substantially at right angles to the back-up wall 22 and lying near the centre of a brick 25 of the veneer wall 21. The connector 10 is fitted to the exposed end 3 of the wall tie 1 ensuring that it is fully engaged with the tie 1 and the hole 14 is left with its axis 16 in a horizontal position. The reinforcement wire 20, which preferably is also a helically twisted wire of smaller gauge than the wall tie 1, is then threaded through adjacent connectors so that it lies along the line of bricks 25 in the bed joint 24 of the veneer wall 21. Mortar is then applied to encase the assembly (not shown) and further courses of bricks are laid on the veneer wall 21. Additional wall reinforcement is added at predetermined intervals as required as the wall is constructed.

If desired, the pull-out capacity of the ties can be tested prior to fitting of the connector 10 using a suitable meter.

Figure 6:
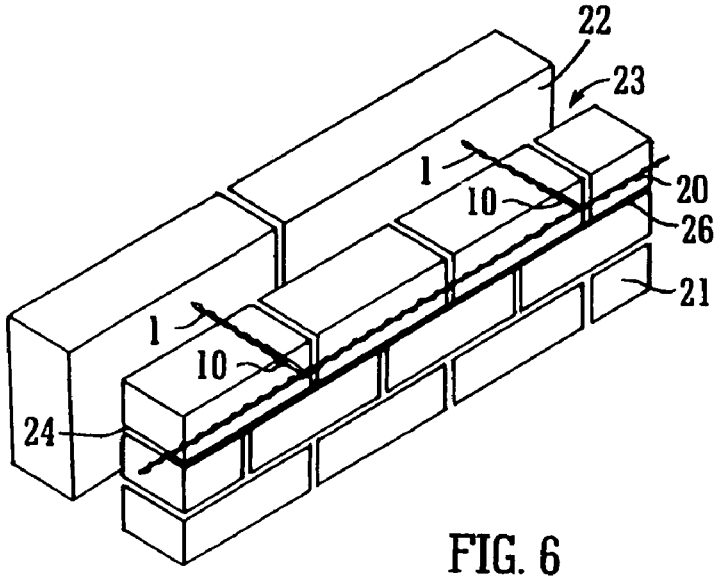
FIG. 6 illustrates the preferred system when used as a repair on an existing building.

FIG. 6 illustrates how the system can be adapted to provide a repair system or an upgrade for existing buildings.

In the repair method, the bed joint 24 and positions where the wall ties 1 are to be inserted are selected. The installer then drills through the veneer wall 21 into the back-up wall 22 with a pilot drill as required for the ties 1. The bed joint 24 is chased to a depth of between 30-40 mm, preferably using a diamond bladed wall chaser with a vacuum attachment. No mortar should be left attached to the exposed brick surfaces to ensure a good mortar bond. All dust and mortar is then removed from the slot 26 and thoroughly flushed with clean fresh water. The bricks 25 should be left damp or primed with a suitable primer. The wall ties 1 are installed with a percussion tool into the back-up wall 22, leaving the exposed end 3 of the wall tie 1 near the centre of the brick 25. A connector 10 is fitted to the wall tie 1 ensuring that it is fully engaged with the wall tie 1 and the axis 16 of the hole 14 left horizontal. The pilot hole drilled in the mortar of the bed joint 24 may need to be made larger, although preferably not all the way to the cavity, for the larger diameter of the connector 10 as necessary. The reinforcement wire 20 is then threaded through adjacent connectors within the gap 26 of the bed joint 24. Bonding filler material, e.g., a cement based or resin based filler material, is then mixed, loaded into a suitable injector device and applied into the gap 26 of the bed joint to seal in the reinforcement wire 20 and connectors 10. Preferably about 15 to 5 mm of the gap 26 is left unfilled for pointing. The bed joint is then pointed with mortar to match the mortar of the existing building.

Figure 7:
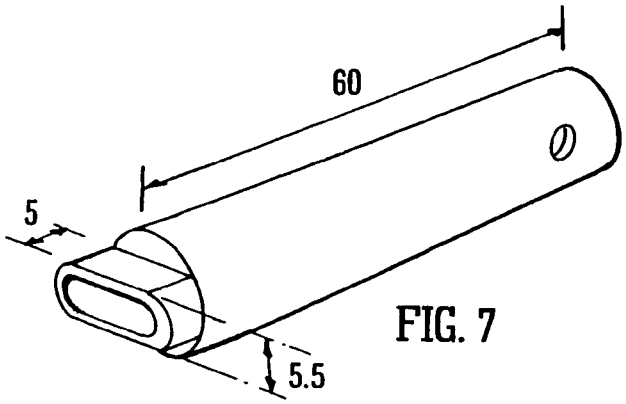
FIG. 7 shows a perspective view of a further preferred connector.
Figure 8:
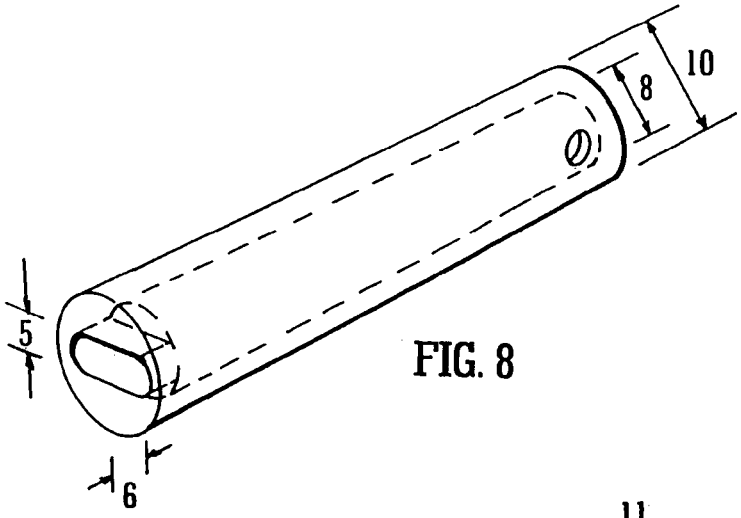
FIG. 8 shows a perspective view of yet a further preferred connector.

FIGS. 7 and 8 show perspective views of two further embodiments for the connector 10. In these embodiments, the narrowed section 11 is formed at the end of the connector 10 rather than part way up.

In the embodiment of FIG. 7, the narrowed section 11 has been formed by crimping the end of the metal tube between a pair of mechanical jaws. The connector is 65 mm long, has a 10 mm external diameter, an 8 mm bore and has been crimped to provide an opposed set of flat surfaces which are 5 mm wide and spaced apart by 5.5 mm.

In FIG. 8 an alternative is illustrated which is moulded, e.g., from a mouldable plastics material such as nylon, to provide a tube having a narrowed section 11 at one end. The tube has an external diameter of 10 mm, a bore of 8 mm and a slot at one end (the narrowed section 11) of width 5 mm and depth in the longitudinal direction of the connector 10 of 6 mm.

Figure 9:
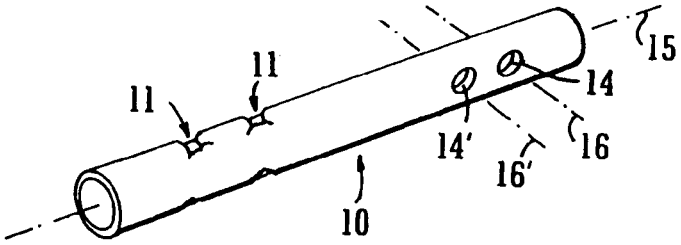
FIG. 9 shows the connector of FIG. 3 provided with a second set of indents.

In FIG. 9 there is shown the connector 10 of FIG. 3 which is provided with a second set of indentations creating a second narrowed section.

In FIG. 9, the connector 10 is also provided with an additional hole 14' for a reinforcement wire 20. Where long lengths of reinforcement wire 20 are required, a first wire 20 can be threaded through a first hole 14 in one direction and a second wire 20 can be threaded through a second hole 14' from the other direction, with an overlap provided at the connector to transmit any forces. Similarly, a further hole 14', i.e. to provide a total of three holes 14, 14' to allow for a staggered overlap arrangement of two main reinforcing wires 20, or further holes 14 or pairs of holes 14, 14' may be provided for situations where additional reinforcement is desired to be carried in the veneer wall 21. Thus the invention also provides a relatively simple way of overlapping reinforcement wires 20 which extend along a bed joint to allow for greater effective lengths of reinforcement.

Figure 10:
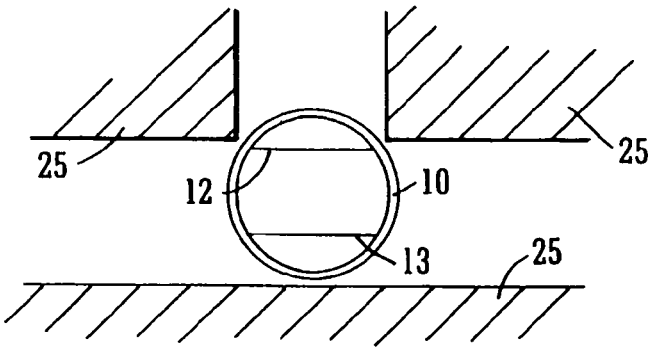
FIG. 10 illustrates the positioning of a large connector in a bed joint.

FIG. 10 shows how a connector 10 which is of greater external diameter than the height of the bed joint 24 can be accommodated easily in the mortar of the veneer wall. If necessary, additional clearance can be created by removing the corner regions of the bricks 25. Such an arrangement can be used when attaching to wall ties 1 of 10 mm diameter or greater.

In another preferred embodiment, known wall ties (e.g., DRYFIX® ties, which are available through Helifix Ltd.) are installed through the "T" joints in the outer wythe mortar 24 and into the back-up wall 22. Connectors 10 are secured over the tie ends and a stainless steel or galvanised plain 9 SWG wire 22 (wire of diameter 3.6 mm) is threaded through the connectors 10 along the cut-out mortar joint. Where extra performance is desired, a wire with helical fins such as Heli-Bar® 45 (which is available through Helifix Ltd. and has a maximum external diameter of 4.5 mm and a core diameter of about 3.1 mm) can be used to provide enhanced strength. The wire 22 is grouted in place with an injectable cementitious, no-shrink grout, such as HELIBOND® MM2 (a trade mark of and available from Helifix Ltd). The joint is then finished with matching tuck-pointing to leave the masonry visually unimpaired.

The wire 20 is positioned between 1" and 2" (25-50 mm) from the face of the veneer 21. Long runs can be achieved by overlapping adjacent wires 20, at a connector 10, by a minimum of 6" (150 mm). As fresh mortar is applied a continuous bond is achieved along the length of the wire 20.

In one preferred method, the steps can be regarded as follows:

1. select the points where 8 mm DRYFIX® ties 1 are to be installed. At the 'T' junction of the mortar bed and vertical joints reduces damage to the brickwork;

2. drill a pilot hole, suitable for the back-up material, through the veneer 21 and into the back-up substrate 22;

3. enlarge the hole through the outer wythe 21 only, to 7/16" (11 mm), to accept the seismic connector 10;

4. cut out the bed joint to a depth of 1¼"-1½" (30-40 mm), preferably using a diamond bladed masonry cutter with vacuum attachment (e.g. Hilti DC-SE 20);

5. make sure no mortar 24 is left attached to the exposed brick surfaces to ensure a good mortar bond;

6. remove all dust and mortar from the slot and thoroughly flush with clean, fresh water. (The bricks should be left damp or primed with a water-based primer such as, for example, HELIFIX® WB Primer);

7. using the insertion tool, drive the DRYFIX® ties into the back-up substrate 22, leaving the tie end near the centre of the outer wythe brick;

8. fit the connector 10, ensuring that it is fully engaged with the tie 1 and the holes 14 are left horizontal;

9. thread the wire 20 through the adjacent connectors 10. (Long continuous runs are made by overlapping adjacent wires 20, at a connector 10, by a minimum of 6" (150 mm));

10. mix the grout and load into the injector;

11. inject the grout over the wire 20 to the back of the slot and fill the slot, ensuring that the wire 20 is completely embedded, and leave ½" to ℜ" (12-15 mm) for matching tuck-pointing to be applied;

12. tuck-point the joints with matching mortar.

It is simple and straightforward to install. The technique is non-disruptive as it requires no taking down and rebuilding. There is a strong, stress free connection with the back-up material. The system creates additional strength in the outer wythe 21. The connector 10 provides a positive lock with easy overlap facility for long runs of the reinforcement wire 22. The reinforcement is fully concealed and visually sympathetic.

Thus there has been described a new system and method for reinforcing a veneer wall against seismic events or adverse wind loading conditions by providing a novel connector for anchoring reinforcement wires laid in the veneer wall to wall ties protruding from a back-up wall. It is also envisaged that the connector could have further application in other systems where a layer is being tied to a back-up surface. For example, it is envisaged that the connector can be used for hanging a second surface from a ceiling back-up layer, where helical wall ties of twisted profiled wire are driven into the ceiling back-up layer and connectors are attached to the protruding ends for suspending the second surface. The second surface could be a metal grill or the like which could, for example, be used for supporting a false ceiling.

We claim:

1. A method of reinforcing a veneer wall by tying it to a back-up wall, comprising:

installing a fastener into the back-up wall, the fastener having a threaded portion which extends substantially at right angles from the surface of the back-up wall to provide a thread for engagement within a tubular connector;

fitting the tubular connector onto the threaded portion of the fastener, the connector internally receiving the fastener and engaging with the thread such that removal of the connector from the fastener is prevented without rotation of the connector, the connector farther having a portion for receiving a reinforcement wire;

fitting the reinforcement wire into said receiving portion of the connector, the reinforcement wire extending substantially at right angles to the fastener and preventing rotation of the connector with respect to the fastener, wherein the reinforcement wire is fitted by threading it through a hole in the receiving portion of the connector, wherein the reinforcing wire is threaded through the hole of one connector, through the hole of an adjacent connector and so forth along the mortar bed joint to link a plurality of connectors and fasteners to a single length of reinforcement wire; and integrating the reinforcement wire with the veneer wall by securing the reinforcement wire within a mortar bed joint of the veneer wall.

2. A method as claimed in claim 1, wherein the fastener is a metal wall tie of a helical type made from twisted profiled wire.

3. A method as claimed in claim 2, wherein the fastener is installed by driving it into the masonry back-up wall using a percussion tool.

4. A method as claimed in claim 3, wherein the fastener extends substantially at right angles to the plane of the back-up wall.

5. A method as claimed in claim 4, wherein the connector is in the form of a sleeve that fits closely over the protruding end of the fastener.

6. A method as claimed in claim 5, wherein the connector is fitted by screwing it on to the threaded portion of the fastener.

7. A method as claimed in claim 1, wherein the reinforcement wire is positioned between 25-50 mm from the external surface of the veneer wall.

8. A method as claimed in claim 1, wherein additional reinforcement wires are laid in parallel along the bed joint and threaded through additional holes in the connectors.

9. A method as claimed in claim 1, wherein the reinforcement wire is a twisted profiled wire.

10. A method as claimed in claim 9, wherein the reinforcement wire extends the length of the wall.

11. A method as claimed in claim 9, wherein the reinforcement wire extends around a building.

12. A method as claimed in claim 1, wherein the connector and reinforcement wire are encased within a mortar bed joint of the veneer wall.

13. A method as claimed in claim 12, wherein the connector is positioned in the bed joint at a junction of a pair of bricks.

14. A method as claimed in claim 1, wherein the method comprises a step of removing mortar from a bed joint in the veneer wall prior to inserting fasteners into the back-up wall.

15. A connector for connecting a reinforcement wire to a wall tie extending substantially at right angles to the reinforcement wire, the wall tie comprising a twisted wire having helical fins extending therealong, wherein the connector comprises:

a tube of internal diameter which closely fits the external diameter of the helical fins of the wall tie for providing a sleeve which engages over one end of the wall tie;

a hole passing through opposing sides of the tube wall substantially at right angles to the longitudinal axis of the tube, the hole being of a size for receiving the reinforcement wire; and at least one region of narrowed internal diameter for engaging the helical fins of the wall tie to prevent withdrawal of the wall tie from the connector without respective rotation between the connector and the wall tie, wherein the region of narrowed internal diameter consists of a crimped section of the connector.

16. A connector as claimed in claim 15, wherein the connector is provided with additional holes for receiving additional reinforcement wires that are laid in parallel along the bed joint.

17. A connector as claimed in claim 15, wherein the region of narrowed internal diameter reduces the distance between opposed internal surfaces of the tube by at least 1 mm.

18. A connector as claimed in claim 15, wherein there are two regions of narrowed internal diameter.

19. A connector as claimed in claim 15, wherein the tube has an internal diameter of between 6 and 12 mm.

20. A connector as claimed in claim 19, wherein the tube has a length of between 50 and 100 mm.

21. A connector as claimed in claim 19, wherein the hole for the reinforcement wire is of a diameter which is 1 mm less than the internal diameter of the tube.

22. A connector as claimed in claim 21, wherein the axis of the tube and the axis of the hole for the reinforcing wire are in-line.

23. A system for reinforcing a veneer wall against seismic conditions or wind loading comprising:

a fastener which is installed into a back-up wall of a structure, the fastener having a threaded portion which extends substantially at right angles from the surface of the back-up wall to provide a thread for engagement within a tubular connector;

a tubular connector which is fitted on to the threaded portion of the fastener, the connector having an internal diameter for internally receiving the fastener and having means for engagement with the thread of the fastener such that removal of the connector from the fastener is prevented without rotation of the connector, the connector further having a portion for receiving a reinforcement wire;

a reinforcement wire which is fitted in to said receiving portion of the connector, the reinforcement wire extending substantially at right angles to the fastener and preventing rotation of the connector with respect to the fastener; and the connector, reinforcement wire and a portion of the fastener being encased in filler material provided within a bed joint of the veneer wall to integrate the reinforcement with the veneer wall, wherein the reinforcement wire is threaded through the receiving portion of one connector, through the receiving portion of an adjacent connector and so forth along the mortar bed joint to link a plurality of connectors and fasteners to a single length of reinforcement wire.

24. A system as claimed in claim 23, wherein the system is used as a repair on an existing building.

25. A system as claimed in claim 24, wherein the system includes a channel for the reinforcement wire formed in a bed joint in the veneer wall.

26. A system as claimed in claim 23, wherein the connector is provided with additional receiving portions for receiving additional reinforcement wires that are laid in parallel along the bed joint.

27. A system as claimed in claim 26, wherein a first of the reinforcement wires is threaded through a first hole of the connector in one direction and a second of the reinforcement wires is threaded through a second hole of the connector from the other direction to provide a staggered overlap to transmit forces from one wire to the next.

28. A system as claimed in claim 27, wherein the reinforcement wires extend around a building.

29. A system as claimed in claim 23, wherein the fastener is a metal wall tie which has been made from twisted profiled wire and is provided with helical fins, the fastener being installed by driving it into the masonry back-up wall using a percussion tool, the fins of the fastener acting as blades which cut a helical path into the masonry under the hammer impacts of the tool so that no adhesive is required to secure the wall tie in position.

30. A method of reinforcing a wall against seismic or adverse wall loading conditions comprising the steps of:

(a) driving one end of a helical wall tie into an inner leaf of said wall, the wall tie being secured in position through mechanical interlock with the inner leaf without the presence of an adhesive, the wall tie having a second end extending substantially at right angles to the plane of the wall;

(b) placing a tubular connector over the second end of the wall tie so that the tubular connector internally receives the wall tie, the connector comprising a portion having a narrowed diameter defined by opposed flats, the flats having a spacing which is less than the external diameter of the helical fins of the wall tie such that withdrawal of the connector along the helical fins of the wall tie requires rotation of the connector, the connector further having a portion with a hole for receiving a reinforcement wire therethrough substantially at right angles to the wall tie;

(c) repeating steps (a) and (b) to provide a plurality of wall ties with each wall tie having a connector placed over its second end;

(d) threading a reinforcement wire through said hole of each connector in turn so as to link the plurality of connectors and fasteners to a single length of reinforcement wire; and (e) securing the reinforcement wire and plurality of connectors in a filler material within a bed joint of a second leaf of the wall.

* * * * *

UNITED STATES PATENT AND TRADEMARK OFFICE

CERTIFICATE OF CORRECTION

PATENT NO. : 7,568,320 B2
APPLICATION NO. : 10/767803
DATED : August 4, 2009
INVENTOR(S) : Paterson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1474 days.

Signed and Sealed this

Seventh Day of September, 2010

David J. Kappos

David J. Kappos
*Director of the United States Patent and Trademark Office*